US006701548B2

(12) United States Patent
Vigneron

(10) Patent No.: US 6,701,548 B2
(45) Date of Patent: Mar. 9, 2004

(54) STACKABLE COT AND CORNER ELEMENT FOR SUCH A COT

(75) Inventor: Bertrand Vigneron, Cholet (FR)

(73) Assignee: Wesco, Cerizay (FR)

( * ) Notice: Subject to any disclaimer, the term of this patent is extended or adjusted under 35 U.S.C. 154(b) by 0 days.

(21) Appl. No.: 10/293,352

(22) Filed: Nov. 14, 2002

(65) Prior Publication Data

US 2003/0088914 A1 May 15, 2003

(30) Foreign Application Priority Data

Nov. 14, 2001 (FR) ..... 01 14701

(51) Int. Cl.[7] ..... A47C 19/00; A47C 19/20

(52) U.S. Cl. ..... 5/110; 5/114

(58) Field of Search ..... 5/110, 111, 114, 5/112, 113, 8, 201, 310; 108/53.3, 53.5; 403/309

(56) References Cited

U.S. PATENT DOCUMENTS 2,924,830 A 2/1960 Long
4,958,390 A 9/1990 Mendenhall
6,513,178 B1 * 2/2003 Kelly et al. ..... 5/110

FOREIGN PATENT DOCUMENTS

EP 1 219 209 A1 7/2002

* cited by examiner

*Primary Examiner*—Alexander Grosz
(74) *Attorney, Agent, or Firm*—Young & Thompson

(57) ABSTRACT

The stackable cot comprises a sheet (5) stretched between elongated longitudinal and transverse elements connected to each other by corner elements (2) so as to form a generally rectangular frame. Each corner element (2) is on its lower surface provided with a foot (6), and on its upper surface provided with a vertical recess (7) aligned with the foot and constituting a recess for reception of a similar foot (6) of another cot (1) of the same type to be stacked on the cot. Each corner element (2) has an upper portion (10) and a lower portion (11) connected to each other. The recess (7) is formed in the upper portion (10) and it comprises a lateral opening in the form of a vertical slot opening outwardly and extending over substantially all the height of the recess (7) opening upwardly.

22 Claims, 3 Drawing Sheets

STACKABLE COT AND CORNER ELEMENT FOR SUCH A COT

The present invention relates to a stackable cot, as well as to a corner element for a stackable cot.

Stackable cots of this type are often used in childcare centers, daycare centers and nursery schools. They generally comprise a cloth stretched over a generally rectangular frame formed by longitudinal and transverse elements connected to each other by corner elements.

Each corner element is, on its lower surface, provided with a foot, and on its upper surface provided with a recess aligned with this foot and constituting a recess for reception of a similar foot of another couch to be stacked on the first couch. In a known couch, the feet have an overall cylindrical shape and the recesses also have an overall cylindrical shape and have a slight play relative to the contour of the feet so as to permit easy stacking of the cots on each other.

This structure is generally satisfactory, but the holes formed by these recesses present a certain danger for young children which could introduce a hand or an object that could wound them. If the hand remains blocked in the hole and the infant loses balance and falls, there is a real risk of a fracture. For this reason, it would be desirable to avoid the formation of such holes on the corner elements.

There is known a cot of this type in which the corner elements are in two portions, an upper portion and a lower portion connected together. In each corner element of this cot, the recess for reception of the foot of an upper cot stacked on the cot is essentially formed by the hollow foot of the lower portion opening upwardly and by a hole in the upper portion aligned with the rest of the recess.

This cot has the drawback mentioned above, and moreover, the corner elements comprise over all their periphery directed outwardly an undesirable joint because if the assembly surfaces are not perfectly aligned, there is necessarily an edge which projects slightly and thus can constitute a risk. Moreover, this presence of a joint can also tempt children to introduce a blade therein to and to wound themselves seriously when playing.

There are also known other cots in which the corner elements comprise on their outer surface quite simply a shoulder against which the foot of a cot comes into abutment when stacked. In this case, the feet are not individually blocked in position when the cots are stacked. They are in effect blocked together because of the fact that they are connected by elements forming the frame of the cot.

A drawback of this type of cot resides in the fact that the corner regions have an interstice or even an elongated hole formed between the sheet metal and the corner elements. This is also to be avoided for the same reasons as given above.

The object of the invention is to provide a cot and a corner element which overcome the drawbacks of the known cots and which moreover permit less expensive production because there is no machining of the pieces and no metallic inserts conventionally necessary for assembly. The invention also permits simplified assembly of the constituent elements of the cot.

The invention has for its object a stackable cot comprising a sheet of cloth stretched between elongated longitudinal and transverse elements connected to each other by corner elements, each corner element being provided with two horizontal holes for the reception and securement of said longitudinal and transverse elements to form together an overall rectangular frame, each corner element being on its lower surface provided with a foot, and on its upper surface provided with a vertical recess aligned with said foot and constituting a recess for the reception of a similar foot of another cot of the same type to be stacked on said cot, each corner element having an upper portion and a lower portion connected to each other, characterized by the fact that said recess for reception of a foot is formed in said upper portion and that it comprises a lateral opening in the form of a vertical slot opening outwardly and extending over substantially over all the height of said recess while opening upwardly.

According to other characteristics of the invention:

- the width of said lateral opening is such that a foot of an upper cot will be held laterally immobilized in said recess (7) without the possibility of outward displacement;
- said upper portion and said lower portion are made of a single piece;
- said upper portion and said lower portion are in two separate pieces connected to each other during assembly of the cot;
- said reception recess is provided in a male member of said upper portion coacting shape-matingly with a female member of said lower portion comprising a lateral opening corresponding to the lateral opening of said recess;
- said foot is hollow, and said male member of the upper portion is at its lower end provided with a transverse element forming a bottom enclosing said foot upwardly when said upper and lower portions are assembled;
- said upper portion and said lower portion comprise an upper lip respectively a lower lip disposed on opposite sides of the cloth sheet in a corner region;
- the upper lip comprises on its lower surface means for retaining said cloth sheet coacting with retaining means disposed on the upper surface of said lower lip;
- the upper lip is inclined toward the lower lip so as to form with this latter said retaining means for said cloth sheet when the first and second portions are assembled;
- said upper portion comprises a skirt extending on opposite sides of said lateral opening of said recess so as to constitute a guide means during assembly of the two portions, and a protection means when the two portions are assembled;
- said upper and lower portions of said corner element are fixed to each other by screw connection means;
- each foot comprises at its free end a hole for securement of a roller.

The invention also has for its object a corner element for a stackable cot, comprising on its lower surface a foot, and on its upper surface a vertical recess aligned with said foot and constituting a recess for reception of a similar foot of another corner element of the same type, and two horizontal holes for reception and securement of elongated longitudinal transverse elements (3, 4) to form a frame, said corner element having an upper portion and a lower portion connected to each other, characterized by the fact that said recess is formed in said upper portion and that it comprises a lateral opening in the form of a vertical slot opening outwardly and extending over substantially all the height of said recess by opening upwardly.

According to other characteristics of the invention:

- said recess is made in a male member of said upper portion coacting shape-matingly with a female member of said lower portion comprising a lateral opening corresponding to the lateral opening of said recess.

Other characteristic and advantages of the invention will become apparent from the description which follows, of a non-limiting embodiment of the invention, with reference to the accompanying drawings, in which.

In the figures, identical or equivalent elements will have the same reference numerals.

Figure 1:
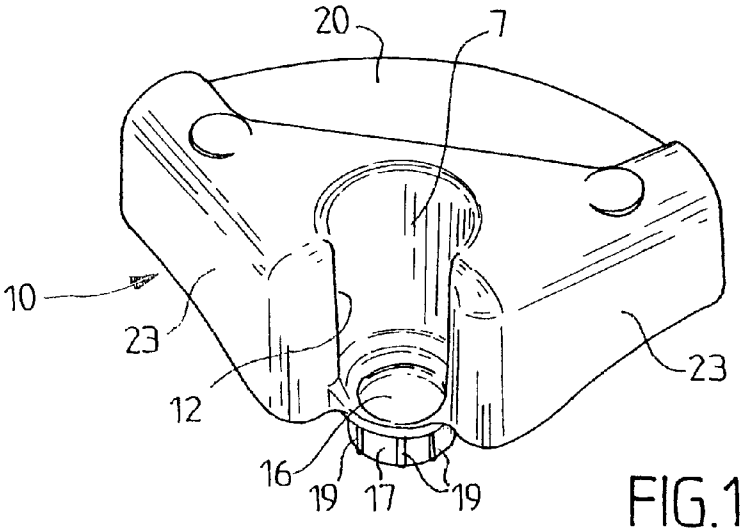
FIG. 1 is a front perspective view of the upper portion of a corner element according to the invention.

The cot 1 supports corner elements 2 interconnected by longitudinal and transverse elements 3, 4 which are generally constituted by metallic tubes. These elements form together an overall rectangular frame on which a cloth sheet 5 is stretched as will be described later with reference to FIG. 7.

The cot is thus provided with four corner elements 2. Each corner element comprises on its lower surface a foot 6 and on its upper surface a vertical reception recess 7 aligned with this foot so as to receive a foot of corresponding shape of a similar cot to be stacked on the immediately lower cot.

Each corner element 2 moreover comprises two horizontal holes for reception and securement, 8, 9 respectively, adapted to receive one end of a longitudinal element 3 and one end of a transverse element 4. These reception holes 8, 9 extend substantially perpendicularly to each other in a horizontal plane.

According to the invention, the corner elements are comprised by an upper portion 10 and a lower portion 11. The upper portion 10 and the lower portion 11 can be of a single piece and have the overall appearance shown in FIG. 5, or else can be in at least two individual and separate pieces which are connected to each other during assembly of the cot, as will be explained in detail later. Independently of the embodiment in one or two pieces, the reception recess 7 is integrally formed in the upper portion 10 and comprises a lateral opening in the form of a vertical slot 12 opening outwardly and extending over substantially all the height of the recess 7 and opening upwardly.

The width of the lateral opening 12 is such that a foot of an upper cot will be held laterally immobilized in the recess 7 without the possibility of outward movement.

Figure 2:
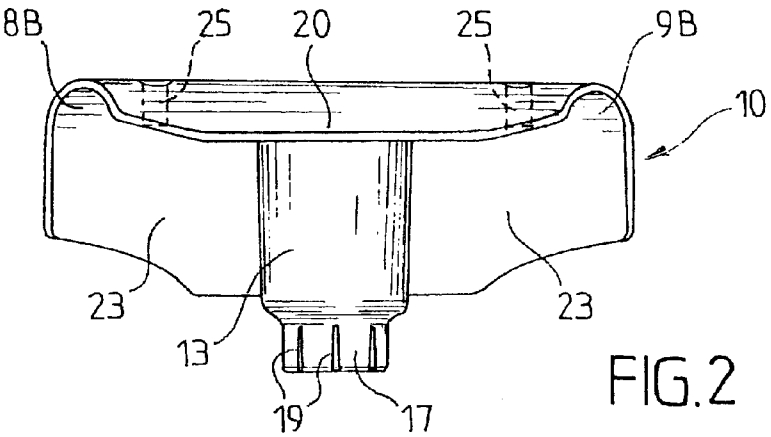
FIG. 2 is a rear side view of the upper portion of FIG. 1.
Figure 3:
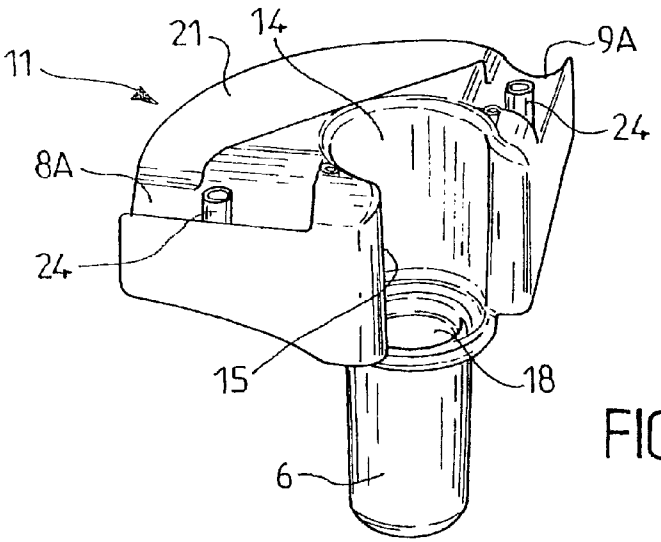
FIG. 3 is a front perspective view of the lower portion of a corner element according to the invention.
Figure 4:
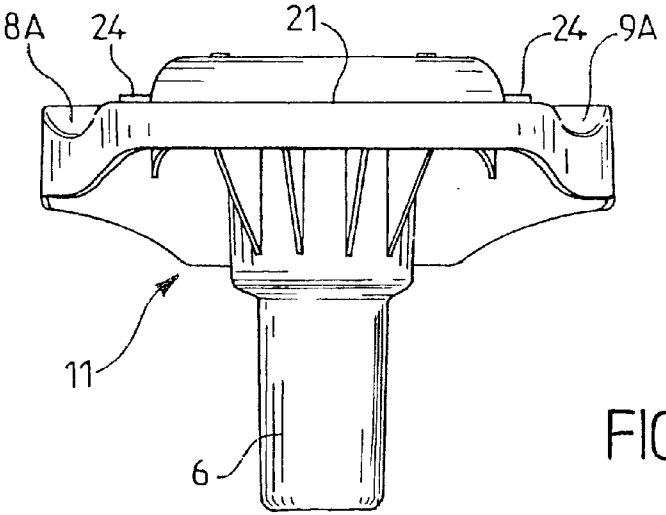
FIG. 4 is a rear side view of the lower portion of FIG. 1.

The recess 7 has a cylindrical shape in the embodiment shown in the figures and is made from a body 13 that is also cylindrical. This body 13 constitutes a male member (see FIG. 2) adapted to coact with a recess 14 (see FIG. 3) on the upper surface of the lower portion constituting a female member. This female member 14 matches in shape the male member 13 and also comprises a lateral opening 15 corresponding to the lateral opening 12 of the upper portion 10. These male and female members here preferably have a circular shape.

Figure 5:
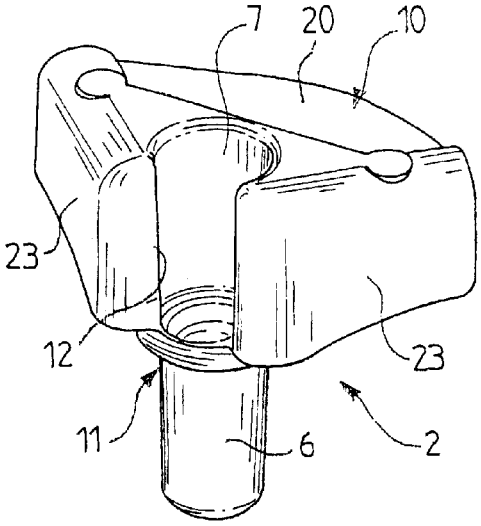
FIG. 5 is a front perspective view of the corner element according to the invention.

In the illustrated example, the foot 6 is hollow and the male member 13 of the upper portion 10 is at its lower end provided with a transverse element 16 forming a bottom and which closes the foot 6 upwardly when the upper and lower portions are assembled (see FIG. 5).

In the embodiment shown in the figures, the end of the male member 13 is provided with a protuberance 17 of reduced cross-section, received in a recess 18 at the lower end of the female member 14 when the two upper and lower portions are assembled.

This protuberance 17 is on its upper surface preferably provided with longitudinal ribs 19 coacting with the wall of the recess 18 so as there to retain this protuberance.

Figure 8:
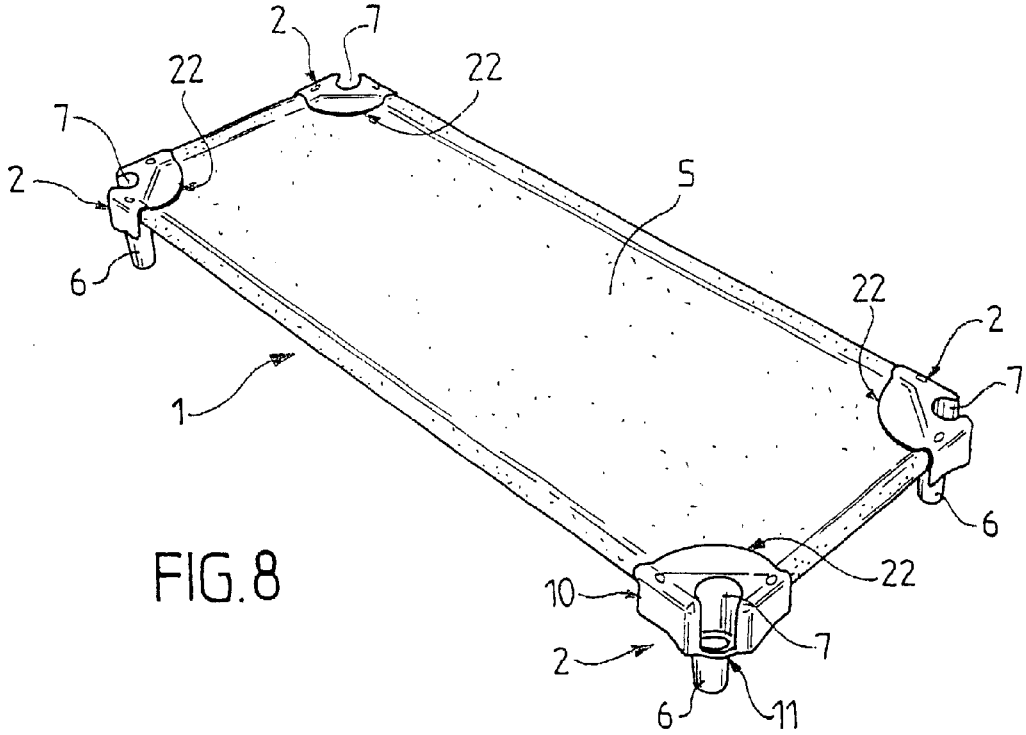
FIG. 8 is a perspective view of a cot according to the invention, after assembly.
Figure 9:
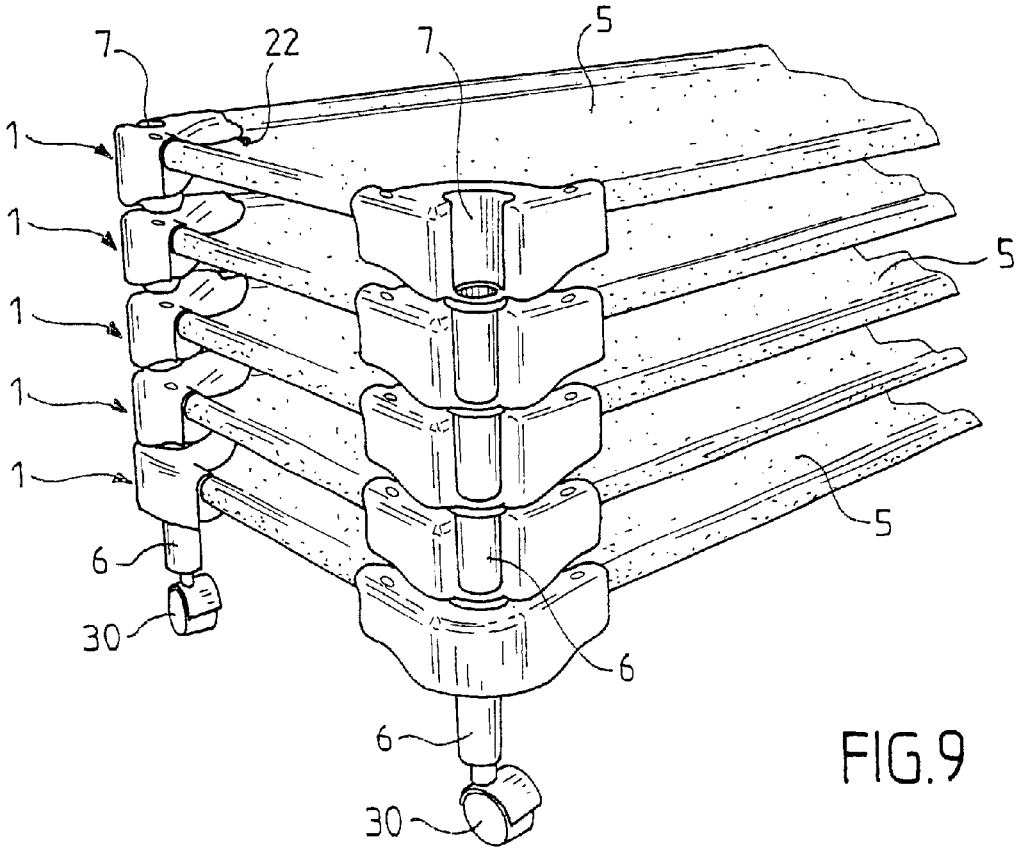
FIG. 9 is a fragmentary perspective view showing the stacking of several cots according to the invention, of which the lowermost cot is provided with rollers.

The upper and lower portions 10, 11 of the corner member 2 comprise an upper lip respectively a lower lip 21 adapted to be disposed on opposite sides of the cloth sheet 5 in a corner region 22 (see FIGS. 8 and 9). Retaining means for the cloth sheet are formed on the lower surface of the upper lip 20 and on the upper surface of the lower lip 21. These retaining means are preferably constituted by lips themselves and to obtain improved gripping force, the upper lip 20 is inclined toward the lower lip 21 such that the lips form a clamp.

According to another modification (not shown), these retaining means for the cloth 5 are constituted by lugs disposed on the upper surface of the lower lip 21 and coact with recesses provided on the lower surface of the upper lip 20, or vice versa.

Preferably, the upper portion 10 comprises moreover a skirt 23 extending on opposite sides of the lateral opening 12 of the recess 7. This skirt constitutes a guide means during assembly of the two portions 10, 11 of the corner element 2 by sliding against the external surface of the lower portion 11 at the same time that the male member 13 of the upper portion penetrates the female member 14 of the lower portion 11. When the upper and lower portions 10, 11 are assembled, the skirt serves also as a protection hiding the joint plane between these two portions when the corner element is made of two pieces as shown in FIG. 6.

Figure 6:
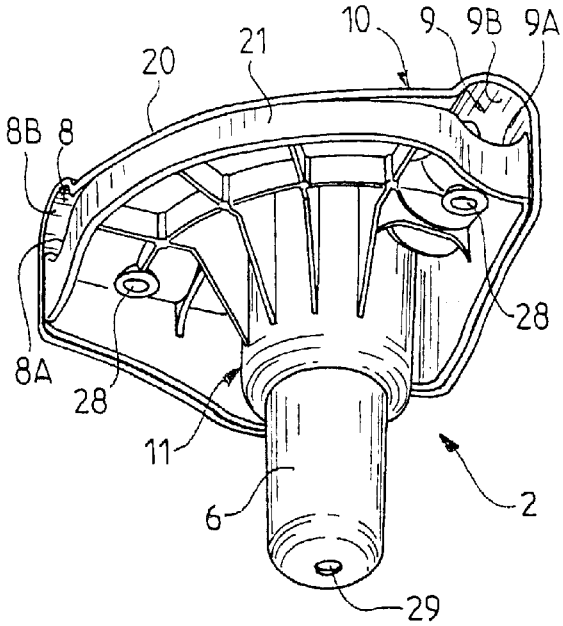
FIG. 6 is a rear perspective view of the corner element according to the invention, after assembly of the upper and lower portions.

For the securement of the longitudinal and transverse elements 3, 4 of the frame of the cot, each hole for reception and securement 8, 9 is formed by a groove 8A, 9A provided in the upper surface of the lower portion 11 and disposed facing an analogous respective groove 8B, 9B provided in the lower surface of the upper portion 10 (see FIG. 6).

So as to immobilize the longitudinal and lateral elements within the reception and securement holes 8, 9 during assembly of the cot, pairs of transverse pins 24, 25 extend from the bottoms of the grooves 8A, 8B respectively 9A, 9B. The pins of each pair of pins 24, 25 pass through opposite securement holes 26 provided in the longitudinal and transverse elements. The pins of each pair of pins 24, 25 are disposed in facing relation so as to permit the introduction of a securement screw 27 through a securement hole 28 by which the pins of the lower portion open downwardly.

The foot 6 of the corner element 2 preferably comprises a central hole 29 constituting a securement hole for a roller 30 by simple snapping in of the axle of the roller into this hole. The rollers remain removable and can preferably be provided with a brake.

Figure 7:
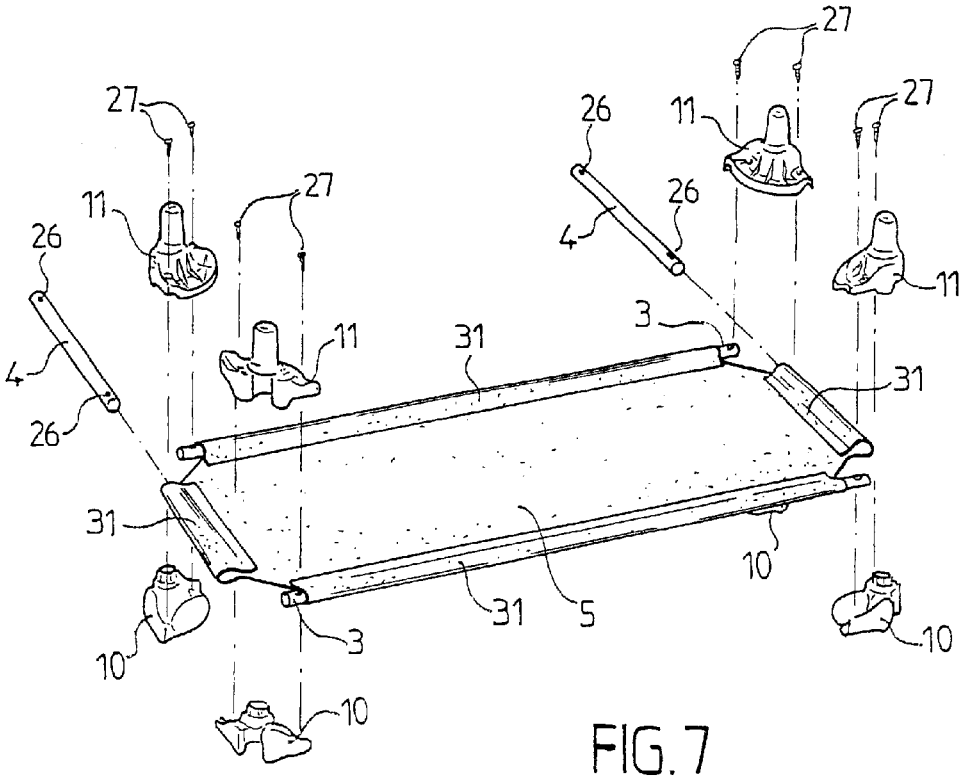
FIG. 7 is a schematic perspective view showing the assembly of a cot according to the invention.

The assembly procedure for the cot comprising corner elements in two pieces is schematically shown in FIG. 7.

The cloth sheet 5 is first cut out to obtain the desired shape permitting obtaining tubular edges 31 by bending and welding or stitching. Each corner of the cloth sheet is cut out to receive a corner element 2.

Then the cloth sheet 5 is turned over and the longitudinal and lateral elements 3, 4 are introduced into the corresponding tubular edges 31. The ends of each element project from the two sides of the tubular edge so as to permit the introduction of the pins 25 of the upper portions 10 into the holes 26 of the longitudinal and lateral elements 3, 4 which thus remain blocked. The lower portions 11 of the corner elements are thus closed over the upper portions 10 by introducing the corresponding pins 24 into the holes in the longitudinal and lateral elements 3, 4. Securement screws 27 are then introduced through holes 28 in the lower surface of the lower portion 11 and the corner element to unite the latter with the upper portion 10 by being screwed into the pins 25.

The assembly of the cot is thus particularly easy and rapid to practice and there is no need for metallic inserts so as to stretch the cloth sheet from one side. The obtained cot is shown in FIG. 8. It is very solid and the longitudinal and lateral elements 3, 4 are entirely blocked in the securement holes 8, 9 of the corner elements and cannot escape.

In the embodiment of the corner elements in a single piece, the assembly of the cot is similar. Of course, the pins 25, 26 within the reception and securement holes 8, 9 of the longitudinal and transverse elements 3, 4 are omitted and replaced by more conventional securement means comprising quite simply a set screw by passing through a transverse hole communicating with the interior of the reception holes 8, 9 to bear directly against the corresponding element 3, 4 or again traversing a passage provided in the wall of this latter.

FIG. 9 shows several cots according to the invention stacked on each other. There is no longer need for a storage accessory especially designed for stacking because the obtained stack is entirely rigid and can moreover be easily moved if the lower cot is provided with rollers 30. This latter can also be used without difficulty if the rollers are provided with brakes to immobilize it.

Thus is obtained a cot which is particularly safe to be used without danger for children of a tender age.

Of course, the invention is not limited to the examples shown and described, but also comprises all modifications within the scope of those skilled in the art without thereby departing from the scope of the invention.

What is claimed is:

1. Stackable cot comprising a sheet (5) stretched between elongated longitudinal and transverse elements (3, 4) connected to each other by corner elements (2), each corner element being provided with two holes for the reception and securement of said longitudinal and transverse elements (3, 4) to form together a generally rectangular frame, each corner element (2) being on its lower surface provided with a foot (6), and on its upper surface provided with a vertical recess (7) aligned with said foot and constituting a recess for the reception of a similar foot (6) of another cot (1) of the same type to be stacked on said cot, each corner element (2) having an upper portion (10) and a lower portion (11) connected with each other, characterized by the fact that said recess for reception of a foot (7) is formed in said upper portion (10) and that it comprises a lateral opening (12) in the form of a vertical slot opening outwardly and extending over substantially all the height of said recess (7) opening upwardly.

2. Stackable cot according to claim 1, characterized by the fact that the width of said lateral opening (12) is such that a foot (6) of an upper cot will be held laterally immobilized in said recess (7) without the possibility of moving outwardly.

3. Stackable cot according to claim 2, characterized by the fact that said upper portion (10) and said lower portion (11) comprise an upper lip (20) respectively a lower lip (21) disposed on opposite sides of the sheet (5) in a corner region (22).

4. Stackable cot according to claim 3, characterized by the fact that the upper lip (20) comprises on its lower surface means for holding said sheet (5) coacting with holding means disposed on the upper surface of said lower lip (21).

5. Stackable cot according to claim 4, characterized by the fact that the upper lip (20) is inclined toward the lower lip (21) so as to form with said latter said holding means of said sheet (5) when the first and second portions (10, 11) are assembled.

6. Stackable cot according to claim 1, characterized by the fact that said upper portion (10) and said lower portion (11) are made of a single piece.

7. Stackable cot according to claim 6, characterized by the fact that said upper and lower portions (10, 11) of said corner member (2) are fixed to each other by screw connection means (27).

8. Stackable cot according to claim 1, characterized by the fact that said upper portion (10) and said lower portion (11) are in two separate pieces connected to each other during assembly of the cot.

9. Stackable cot according to claim 8, characterized by the fact that said recess (7) is provided in a male member (13) of said upper portion (10) coacting shape-matingly with a female member (14) of said lower portion (11) comprising a lateral opening (15) corresponding to the lateral opening (12) of said recess (7).

10. Stackable cot according to claim 9, in which said foot (6) is hollow, characterized by the fact that said male member (13) of the upper portion (10) is at its lower end provided with a transverse element (16) forming a bottom enclosing said foot (6) upwardly when said upper and lower portions (10, 11) are assembled.

11. Stackable cot according to claim 8, characterized by the fact that said upper portion (10) comprises a skirt (23) extending on opposite sides of said lateral opening (12) of said recess (7) so as to constitute a guide means during assembly of the two portions (10, 11), and protection means when the two portions are assembled.

12. Stackable cot according to claim 1, characterized by the fact that each foot comprises at its free end a securement hole (21) for a roller (30).

13. Corner element for a stackable cot, comprising on its lower surface a foot (6), and on its upper surface a vertical recess (7) aligned with said foot and constituting a recess for receiving a similar foot (6) of another corner member (2) of the same type, and two horizontal holes for receiving and securing elongated longitudinal and transverse elements (3, 4) to form a frame, said corner element having an upper portion (10) and a lower portion (11) connected to each other, characterized by the fact that said recess (7) is formed in said upper portion (10) and that it comprises a lateral opening (12) in the form of a vertical slot opening outwardly and extending over substantially all the height of said recess (7) opening upwardly.

14. Corner element for a stackable cot according to claim 13, characterized by the fact that the width of said lateral opening (12) is such that a foot (6) of another corner element (2) will be held laterally immobilized in said recess (7) without the possibility of outward movement.

15. Corner element for a stackable cot according to claim 13, characterized by the fact that said upper portion (10) and said lower portion (11) are made of a single piece.

16. Corner element for a stackable cot according to claim 13, characterized by the fact that said upper portion (10) and said lower portion (11) are of two separate pieces connected to each other during assembly of the cot.

17. Corner element for a stackable cot according to claim 13, characterized by the fact that said recess (7) for reception is made in a male member (13) of said upper portion (10) coacting shape-matingly with a female member (14) of said lower portion (11) comprising a lateral opening (15) corresponding to the lateral opening (12) of said recess (7).

18. Corner element for a stackable cot according to claim 13, characterized by the fact that said upper portion (10) and said lower portion (11) comprise an upper lip (20) respectively a lower lip (21) adapted to be disposed on opposite sides of a sheet (5).

19. Corner element for a stackable cot according to claim 18, characterized by the fact that the upper lip (20) comprises on its lower surface means for retaining said sheet (5) coacting with retaining means disposed on the upper surface of said lower lip (21).

20. Corner element for a stackable cot according to claim 19, characterized by the fact that the upper lip (20) is inclined toward the lower lip (21) so as to form with this latter said retaining means of said sheet (5) when the first and second portions (10, 11) are assembled.

21. Corner element for a stackable cot according to claim 13, characterized by the fact that said upper portion (10) comprises a skirt (23) extending on opposite sides of said lateral opening (12) of said recess (7) so as to constitute a guide means during assembly of the two portions, and a protection means when the two portions (10, 11) are assembled.

22. Corner element for a stackable cot according to claim 13, characterized by the fact that the foot (6) comprises at its free end a securement hole (29) for a roller (30).

* * * * *